US005385414A

United States Patent [19]

Shirotori et al.

[11] Patent Number: 5,385,414

[45] Date of Patent: Jan. 31, 1995

[54] PRINTING HEAD AND ITS DRIVE TIMING CONTROL CIRCUIT FOR IMPACT PRINTER

[75] Inventors: Hiroshi Shirotori; Katsuhiko Nishizawa; Shigeki Mizuno; Teturo Takahashi, all of Suwa, Japan

[73] Assignee: Seiko Epson Corporation, Tokyo, Japan

[21] Appl. No.: 33,037

[22] Filed: Mar. 18, 1993

[30] Foreign Application Priority Data

| | | | |
|---|---|---|---|
| Mar. 23, 1992 | [JP] | Japan | 4-064880 |
| Mar. 23, 1992 | [JP] | Japan | 4-064881 |
| Aug. 25, 1992 | [JP] | Japan | 4-226202 |
| Aug. 25, 1992 | [JP] | Japan | 4-226216 |

[51] Int. Cl.[6] ..... B41J 2/30

[52] U.S. Cl. ..... 400/124.02; 400/124.04

[58] Field of Search ..... 400/124 VI, 124.02, 400/124.24, 124.04, 124.27; 101/93.05

[56] References Cited

U.S. PATENT DOCUMENTS

| | | | |
|---|---|---|---|
| 4,071,130 | 1/1978 | Lichti | 101/93.05 |
| 4,567,570 | 1/1986 | Peer | 400/124.04 |
| 5,048,984 | 9/1991 | Kringe et al. | 400/124.02 |
| 5,150,108 | 9/1992 | Markham | 400/12.02 |
| 5,310,270 | 5/1994 | Matsukura | 400/124.02 |

FOREIGN PATENT DOCUMENTS

| | | |
|---|---|---|
| 454412 | 11/1988 | European Pat. Off. . |
| 59860 | 4/1983 | Japan . |
| 0171600 | 9/1984 | Japan . |
| 251719 | 7/1985 | Japan . |
| 632907756 | 10/1991 | Japan . |

OTHER PUBLICATIONS

Patent Abstracts of Japan, vol. 13, No. 118 (3466). Mar. 23, 1989.

*Primary Examiner*—Edgar S. Burr
*Assistant Examiner*—John S. Hilten
*Attorney, Agent, or Firm*—Ladas & Parry

[57] ABSTRACT

In a serial impact printer, a printing head having an impact wire pin array of two arrangement lines is mounted on a carriage in such a way that the pin arrangement lines are inclined by an angle $\theta$ with respect to the virtual vertical direction. The respective wire pins in the array are driven at timings different delay time by delay time according to the inclination angle $\theta$. The control circuit for determining the drive timings comprises a circuit for turning on the respective wire pins at the delay time intervals and a circuit for turning off the respective wire pins in sequence at the delay time intervals after a predetermined time has elapsed. It is desirable that the inclination angle $\theta$ satisfies the following formula:

$$\tan\theta \leqq a/(2\cdot b)$$

where 2a denotes the pitch between two adjacent wire pins arranged along a single arrangement line of the array, and b denotes a distance between the two arrangement lines of the array.

2 Claims, 13 Drawing Sheets

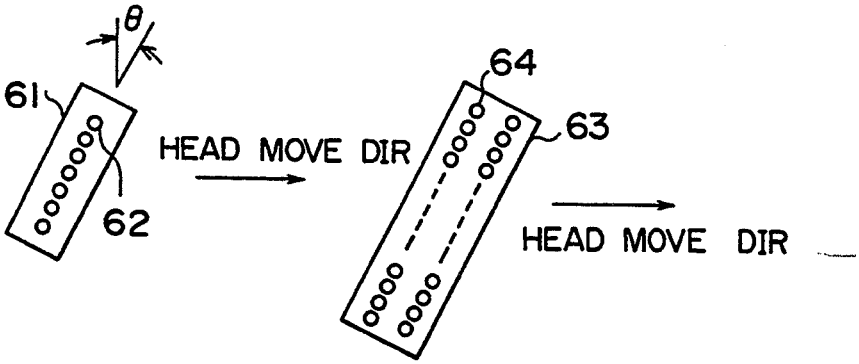
FIG.1A PRIOR ART
FIG.1B PRIOR ART
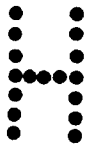
FIG.1C PRIOR ART
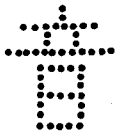
FIG.1D PRIOR ART
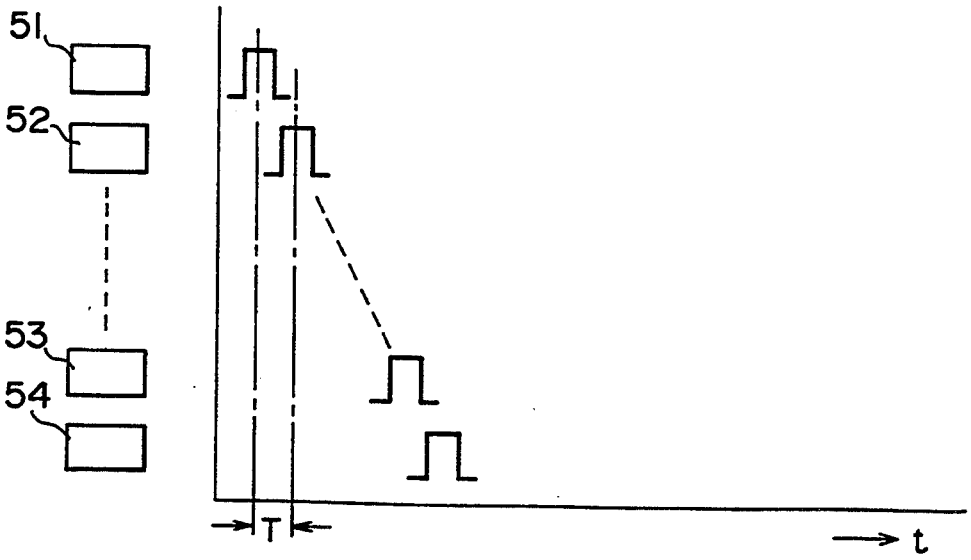
FIG.2 PRIOR ART

PRINTING HEAD AND ITS DRIVE TIMING CONTROL CIRCUIT FOR IMPACT PRINTER

BACKGROUND OF THE INVENTION

The present invention relates to a control circuit for controlling the timing of driving a plurality of wire pins provided for a printing head of a serial impact printer, and more specifically to a control circuit for driving the wire pins of the printing head provided with inclined wire pin arrangement lines at different timings to reduce noise.

The serial impact printer for striking a recording paper with a wire pin array provided for a printing head is widely used because of its excellent cost performance. However, since a number of wire pins are collided against a recording paper at the same time, there exists a problem in that the printing noise is large. The methods of overcoming the above-mentioned problem are disclosed in Japanese Published Unexamined Patent Application No. 50-104534 and 56-144170. In the case of the Application No. 56-144170, as shown in FIGS. 1A and 1B, the wire pin arrangement line 62 or lines 64 of a printing heads 61 or 63 are arranged being inclined by an angle—with respect to a virtual vertical printing direction; and the wire pins are driven by drive pulses of different delay times generated by delay circuits 51 to 54 as shown in FIG. 2 to print character lines along the virtual vertical direction as shown in FIGS. 1C and 1D, with the result that a number of printing wires are not driven at the same time for reduction of noise.

In the above-mentioned prior art printing timing control method by use of the time delay circuits, however, since it is require to complete the driving operation of all the wire pins within a one printing period, in the case of a high speed printing it is difficult to obtain sufficient delay time, so that the wire pin driving time periods overlap with each other and thereby it is impossible to sufficiently reduce the printing noise. In addition, in case where the mounting angle $\theta$ of the inclined printing head deviates mechanically by an error $\Delta\theta$ as shown in FIG. 3, it is difficult to achieve an accurate printing by simply determining a delay time corresponding to the mounting angle $\theta$.

Further, in the printing head of the prior art printer, the arrangement position of the wire pins is different from the ordinary wire pin arrangement position (i.e., the wire pins are arranged in the virtual vertical direction). This is because character patterns must be printed accurately even under the condition that the wire pin arrangement lines are inclined by a predetermined angle $\theta$. In other words, since the prior art printing head is a special one, and therefore the ordinary printing head is not usable as the prior art printing head.

SUMMARY OF THE INVENTION

Accordingly, in the serial printer using a printing head provided with an inclined wire pin arrangement line, the first object of the present invention is to obtain a sufficient delay time between the wire pins even at high speed printing, for prevention of the wire pin driving time periods from being overlapped.

The second object of the present invention is to compensate for an error $\Delta\theta$ of the inclination angle $\theta$ of the wire pin arrangement line by controlling the timings of driving the wire pins.

The third object of the present invention is to realize printing of both high reliability and low noise with the use of the ordinary printing head provided with two pin arrangement lines in each line of which the wire pins are arranged in zigzags fashion under the condition that the wire pin arrangement lines are inclined.

The first aspect of the present invention provides a circuit of an impact printer provided with a printing head including an array composed of impact elements arranged being inclined with respect to a virtual vertical direction, for controlling timing of driving each of the impact elements so that the impact elements of the array are driven on a line along the virtual vertical direction, comprising: delay rate register means for storing a predetermined delay time according to an inclination angle of the impact elements; turn-on time generating means for generating a turn-on time signal having a predetermined time width according to a scanning speed of the printing head; start timing control means responsive to a start of the turn-on time signal, for starting driving the impact elements of the array in sequence at the delay time intervals; and stop timing control means responsive to an end of the turn-on time signal, for stopping driving the impact elements of the array in sequence at the delay time intervals.

The second aspect of the present invention provides a serial impact printer provided with a printing head having an impact element array arranged in such a way that two arrangement lines (L, R) each composed of a plurality of impact elements arranged at positional intervals of $2a$ are positioned in parallel to each other a distance $b$ apart from each other and further centers of the respective impact elements of a first arrangement line (R) are located on lines passing through respective middle points between the two adjacent impact elements of the second arrangement line (L) and perpendicular to a direction along which the second arrangement line (F) is set, wherein the printing head is mounted on a carriage under condition that two arrangement lines (L, R) are inclined with respect to a virtual vertical direction by an angle $\theta$ which satisfies the following formula:

$$\tan\theta \leqq a/(2\cdot b)$$

The third aspect of the present invention provides a serial impact printer wherein the printing head is mounted on a carriage under the condition that two arrangement lines (L, R) are inclined with respect to a virtual vertical direction by an angle $\theta$ which satisfies the following formula:

$$b(1-\cos\theta)/e\times 100 \leqq 4$$

where e denotes a pitch between printing dots of the impact elements.

BRIEF DESCRIPTION OF THE DRAWINGS

FIGS. 1A, 1B, 1C and 1D are illustrations for assistance in explaining the wire pin arrangement line or lines and printed characters of a prior art impact printer;

FIG. 2 is an illustration for assistance in explaining the method of controlling the drive timing of the wire pins of the prior art impact printer;

DETAILED DESCRIPTION OF THE PREFERRED EMBODIMENTS

Figure 3:
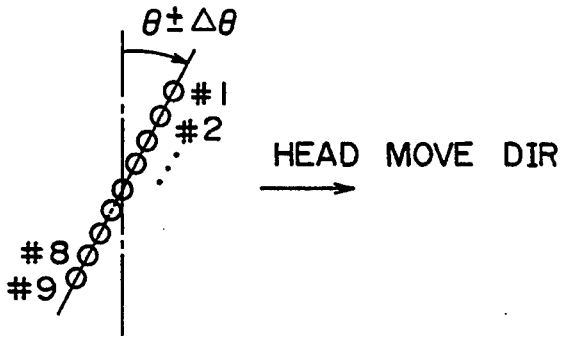
FIG. 3 is an illustration showing the arrangement of the wire pins of a printing head used for a first embodiment of the present invention.
Figure 4:
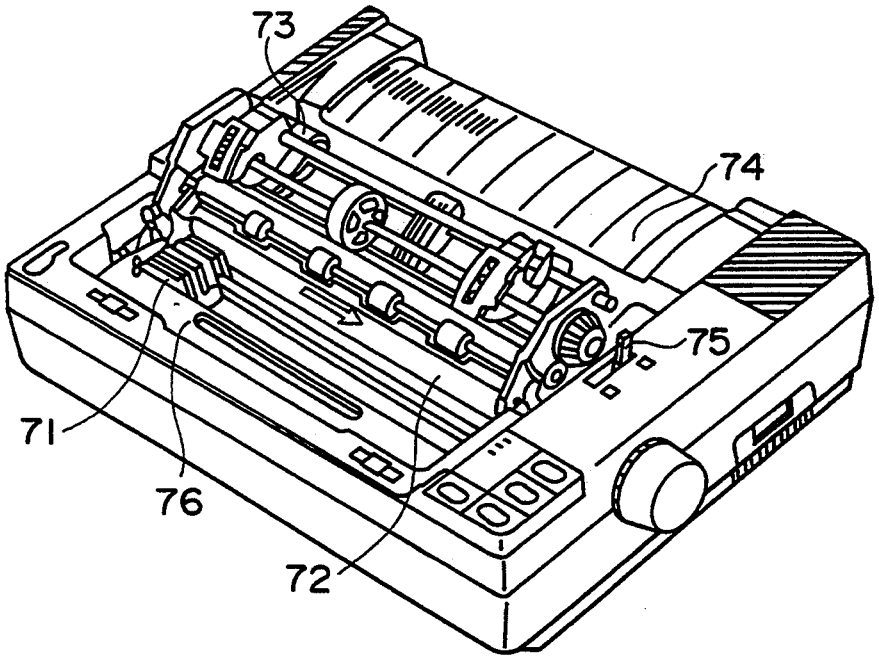
FIG. 4 is a perspective view showing a first embodiment of the impact printer according to the present invention.

The present invention will be described hereinbelow in accordance with embodiments. FIG. 4 is a perspective view showing an impact printer according to the present invention. The printer includes a printing head 71, an ink ribbon 76 and a platen 72. The printing head is provided with a wire pin arrangement line composed of nine pins #1 to #9 inclined by an angle $\theta$ with respect to the virtual vertical direction as shown in FIG. 3. The printing is made in the state where a printing paper (not shown) is mounted on a pull tractor 73 or 74. Further, a release lever 75 is provided for switching the paper feed by the tractor 73 to the paper feed by frictional force between the platen 72 and a paper feed roller (not shown) when a slip paper is required to be printed, for instance.

Figure 5:
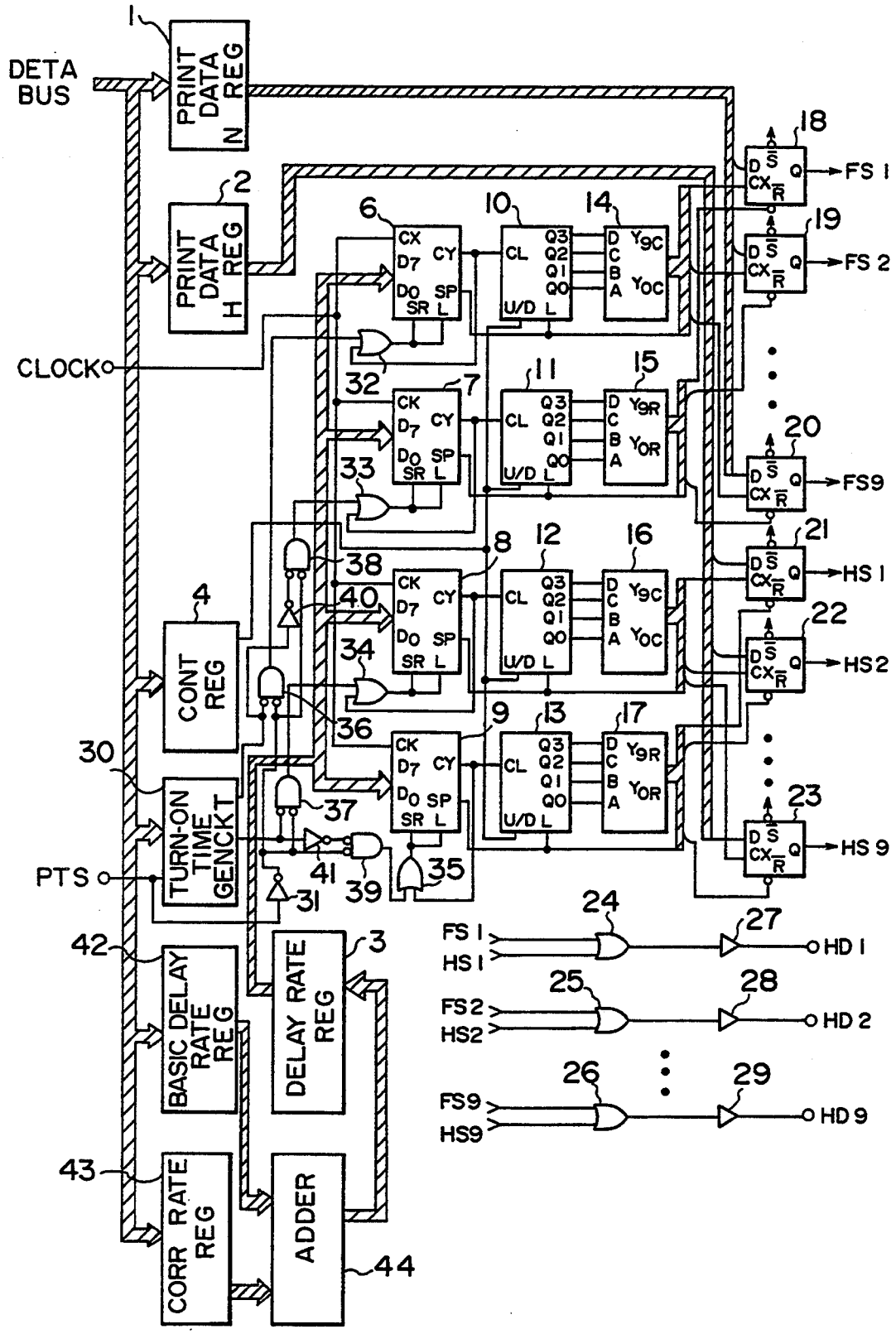
FIG. 5 is a block diagram showing a first embodiment of the drive timing control circuit.

FIG. 5 is a block diagram showing a first embodiment of the circuit for controlling the timing of driving the wire pins according to one aspect of the present invention. For enabling a high speed printing, printing data are stored alternately to a printing data N register 1 and a printing data H register 2 for each printing timing. A delay rate-register 3 stores the delay rate data of printing timing signals for the respective wire pins. The delay rate data are obtained by adding the values stored in a basic delay rate register 42 for storing basic delay rates according to the printing mode (the carriage scanning mode) and the values stored in a correction rate register 43 for storing correction time according to an error angle—by use of an adder 44. A turn-on time generating circuit 30 generates turn-on time signals HPW1 and HPW2 for determining the printing head turn-on time width in synchronism with the basic printing timing signal PTS outputted according to the printing mode from an external control circuit (not shown). Further, the turn-on signals HPW1 and HPW2 are outputted alternately in response to the basic printing timing signal PTS. The turn-on signal HPW1 is used for the data in the printing data N register 1 and the turn-on signal HPW2 is used for the data in the printing data H register 2. Although being described in further detail later, these turn-on signals are used so that sufficient delay time can be obtained even at high speed printing and further the respective wires can be driven without overlap with respect to each other.

The counter 6 is a 8-bit counter for generating a delay time for delaying the turn-on start time, which sets the value of the delay register 3 as an initial count value in response to the falling edge of the turn-on time signal HPW1, and starts down-counting on the basis of a reference clock CLOCK to output an output signal when the counted value reaches zero. By repeating the above-mentioned operation, the output signal of the 8-bit counter 6 is generated at the delay time intervals determined by the delay time register 3. In response to the output signal received as a clock signal, a 4-bit counter 10 starts up-counting or down-counting according to the signal form a control register 4. The output of the 4-bit counter 10 is decoded by a decimal decoder 14, and nine pulses Y0C to Y8C are generated in sequence at the delay time intervals. In synchronism with these pulses Y0C to Y8C, the respective bits of data stored in the printing data N register 1 are stored in nine flip-flops 18 to 20 as (FS1 to FS9), respectively to start driving the wire pins. The final pulse Y9C of the decimal decoder 14 is a signal for initializing the counted value of the 4-bit counter 10 and further stopping the operation of the 8-bit counter 6, until the falling edge of the turn-on start signal HPW1 is inputted.

A counter 7 is a 8-bit counter for generating a delay time for delaying the turn-on end time, which sets the value of the delay rate register 3 as the initial count value in response to the rising edge of the turn-on time signal HPW1; starts down-counting in response to the reference clock signal CLOCK; and outputs an output signal when the counted value reaches zero values. By repeating the above-mentioned operation, the output signal of the 8-bit counter 7 is generated at the delay time intervals determined by the delay rate register 3. In response to this output signal as a clock, a 4-bit counter 11 starts up-counting or down-counting according to the signal form a control register 4. The output of the 4-bit counter 11 is decoded by a decimal decoder 15, and nine pulses Y0R to Y8R are generated in sequence at the delay time intervals. In synchronism with these pulses Y0R to Y8R, the respective nine flip-flops 18 to 20 are reset in sequence to stop driving the wire pins. The final pulse Y9R of the decimal decoder 15 is a signal for initializing the counted value of the 4-bit counter 11 and further stopping the operation of the 8-bit counter 7, until the rising edge of the turn-on start signal HPW1 is inputted.

With respect to the turn-on time signal HPW2, the similar circuit configuration is provided. In this case, the respective bits in the printing data H register 2 are stored in flip-flops 21 to 23 as (HS1 to HS9) in sequence at the delay time intervals determined by the delay rate register 3, and further reset after having been held for a predetermined turn-on time.

Figure 6:
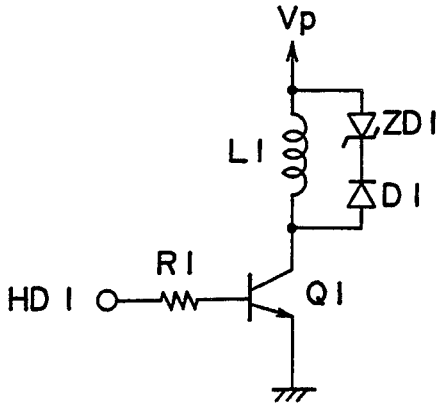
FIG. 6 is a circuit diagram showing a solenoid driving circuit for wire pin actuation.

Further, a pair of the output signals FS1 and HS1 of the flip-flops 18 and 21, a pair of the output signals FS2 and HS2 of the flip-flops 19 and 22, . . . , a pair of the output signals FS9 and HS9 of the flip-flops 20 and 23 are logically summed, respectively to obtain drive signals HD1 to HD9. These drive signals are inputted to drive circuits (as shown in FIG. 6) to drive the respective wire pins. Further, in FIG. 6, the drive circuit is composed of a transistor Q1, a Zener diode ZD1, a diode D1, etc. The transistor Q1 is a switch for energizing or deenergyzing an electromagnet coil L1. These diodes ZD1 and D1 serve to absorb the inverse electromotive force generated by the coil L whenever the transistor Q1 is turned off.

The operation of the circuit as described above will be described hereinbelow with reference to a timing chart shown in FIG. 7.

Figure 7:
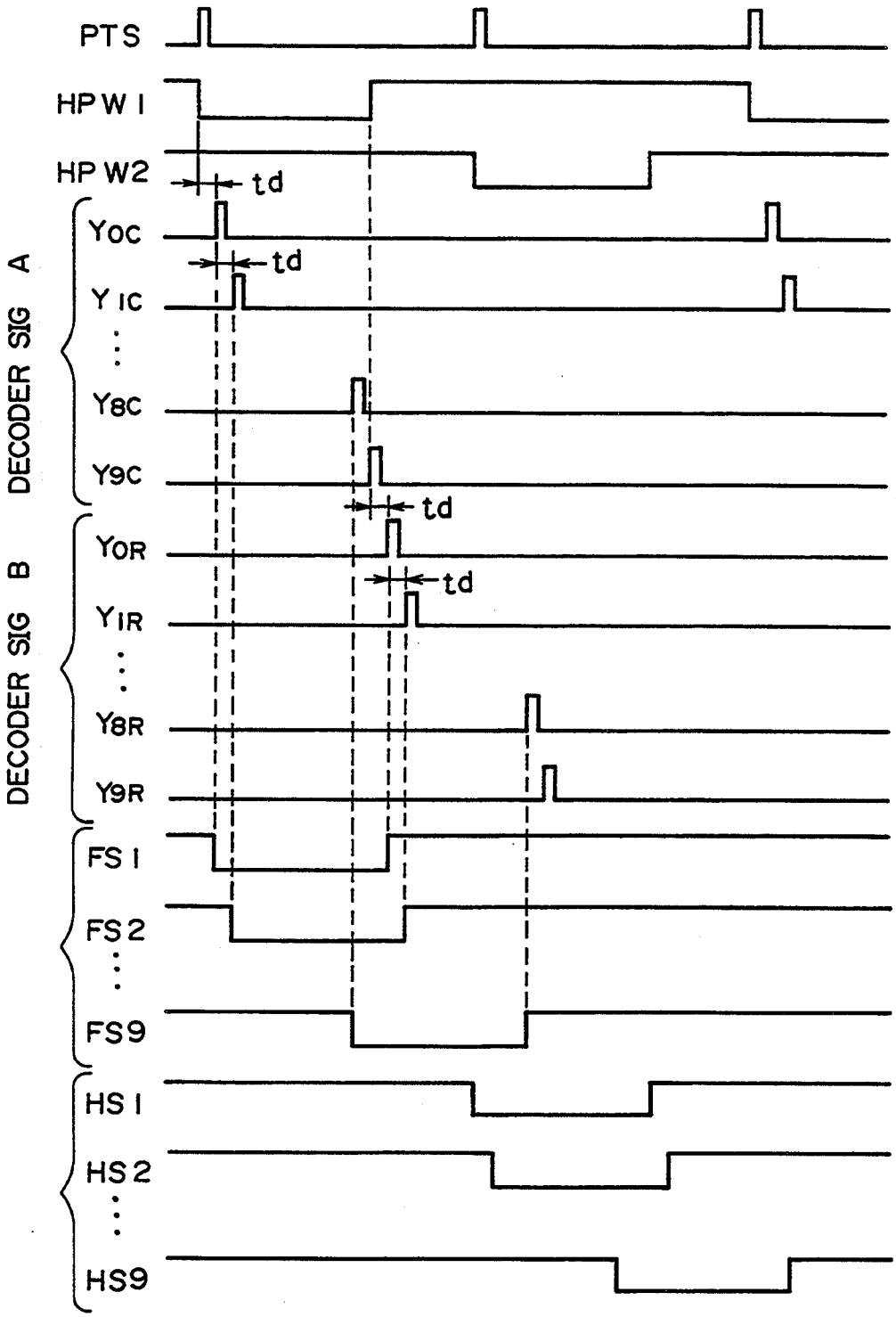
FIG. 7 is a timing chart for assistance in explaining the operation of the circuit shown in FIG. 5.

FIG. 7 is a timing chart for assistance in explaining the control operation of when the printing head having the wire pins #1 to #9 arranged along an arrangement line inclined by an angle $\theta$ with respect to the virtual vertical line as shown in FIG. 3 is scanned in the arrow direction. In this case, the control register 4 outputs a select signal for selecting up-counting to the 4-bit up-down counters 10 to 13, respectively. The count value of the counter 10 is $-1$. When printing data are written to the printing data N register 1 and further the printing basic timing signal PST is inputted to the turn-on time generating circuit 30, the turn-on time generating circuit 30 outputs the turn-on time signal HPW1. In response to the falling edge of this turn-on time signal HPW1, the 8-bit counter 6 starts counting the delay time td. When the delay time td has elapsed, a clock signal is generated from the 8-bit counter 6 to the 4-bit up-down counter 10, so that the count value of the counter 10 changed from $-1$ to 0. Then, the a signal Y0C is outputted from the decimal decoder 14, so that a bit corresponding to the wire pin #1 stored in the printing data N register 1 is stored in the flip-flop 18 as FS1. When another delay time td has elapsed, a clock signal is outputted from the 8-bit counter 6 to the 4-bit up-down counter 10, so that the count value of the counter 10 changed to 1. Then, a signal Y1C is outputted from the decimal decoder 14, a bit corresponding to the wire pin #2 stored in the printing data N register 1 is stored in the flip-flop 19 as FS2. Successively, bits corresponding to the wire pins #3 to #9 are stored at the delay time intervals td. After the bit corresponding to the wire pin #9 has been stored as FS9 and further the delay time td has elapsed, the count value of the 4-bit up-down counter 10 is 9, so that a signal Y9C is outputted from the decimal decoder 14 in order to stop the delay time (td) counting of the 8-bit counter 6 and to reset the initial count value of the 4-bit up-down counter 10 to $-1$.

In response to the rising edge of the turn-on time signal HPW1, the 8-bit counter 7 starts counting the delay time td. When the delay time td has elapsed, a clock signal is generated from the 8-bit counter 7 to the 4-bit up-down counter 11, so that the count value of the counter 11 changed to 0. Then, the a signal Y0R is outputted from the decimal decoder 15 to clear the bit data FS1 corresponding to the wire pin #1 and stored in the flip-flop 18. When another delay time td has elapsed, a clock signal is outputted from the 8-bit counter 7 to the 4-bit up-down counter 11, so that the count value of the counter 11 changed to 1. Then, a signal Y1R is outputted from the decimal decoder 15 to clear a bit data FS2 corresponding to the wire pin #2 and stored in the flip-flop 19. Successively, bit data corresponding to the wire pins #3 to #9 are cleared at the delay time intervals td. After the bit data FS9 corresponding to the wire pin #9 has been cleared and further the delay time td has elapsed, the count value of the 4-bit up-down counter 11 is 9, so that a signal Y9C is outputted from the decimal decoder 15 in order to stop the delay time (td) counting of the 8-bit counter 7 and to reset the initial count value of the 4-bit up-down counter 11 to $-1$.

The succeeding printing data are written to the other printing data H register 2. This is because when the succeeding printing basic timing signal PTS is inputted, another turn-on time signal HPW2 is outputted. In quite the same way as above, bits corresponding to the wire pins #1 to #9, respectively are stored in sequence as signals HS1 to HS9 at the delay time intervals td.

By outputting the turn-on time signals HPW1 and HPW2 alternately as described above, it is possible to determine the product value of the turn-on time and the delay time within an allowable range twice as long as the maximum basic printing timing period, thus enabling a sufficient delay time even at a high speed printing.

Further, in the above-mentioned embodiment, since the timing signals for driving the respective wire pins are controlled by including the correction of dispersion in the mounting angle of the printing head, it is possible to obtain a higher printing quality.

An embodiment of the second aspect of the printing head according to the present invention will be described hereinbelow.

Figure 8:
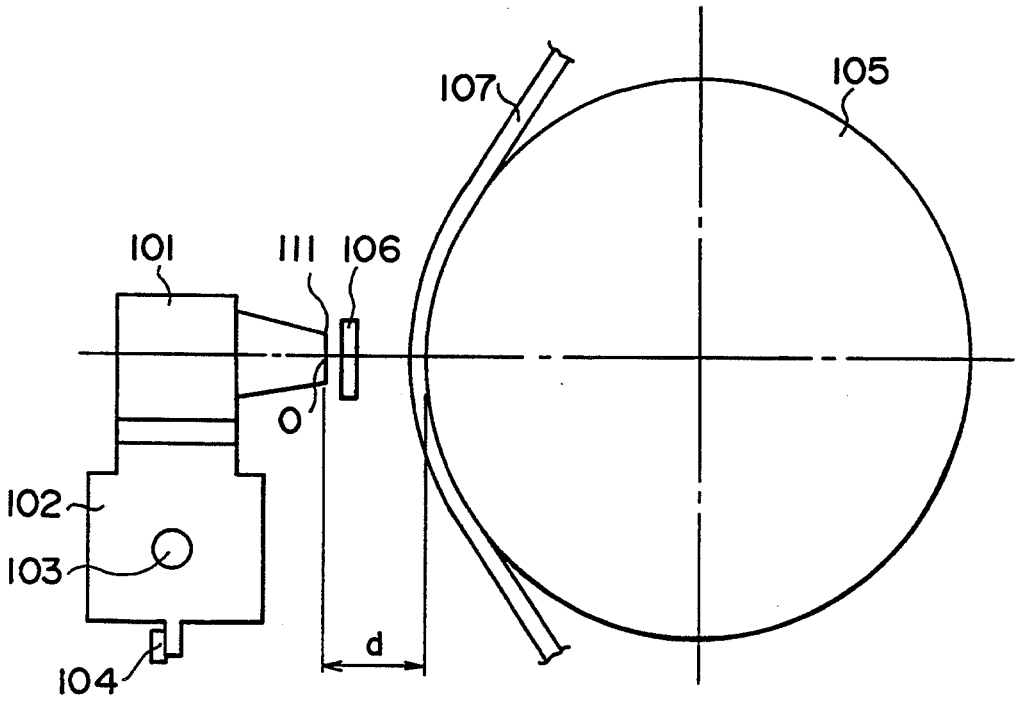
FIG. 8 is a side view showing the positional relationship between a carriage, a head and a platen of a second embodiment of the present invention.

FIG. 8 is a cross-sectional view showing the mutual positional relationship between the printing head and the platen. A printing head 101 is mounted on a carriage 102 so as to be opposed to the platen 105 in such a way that the horizontal diameter line of the platen 105 is aligned with the central position O of the wire line as described later. In addition, the carriage 102 on which a belt 104 is mounted is supported by a shaft 103 and driven (i.e., scanned) by a motor (not shown) along the shaft 103 in the direction parallel to the axis of the platen 105 (in the vertical direction on the paper). The wire pins are arranged on a head portion 111 of the printing head 101. Therefore, characters can be printed by scanning the printing head 101 and by striking a printing paper 107 by the selected wire pins with an ink ribbon 106 interposed therebetween.

Figure 9:
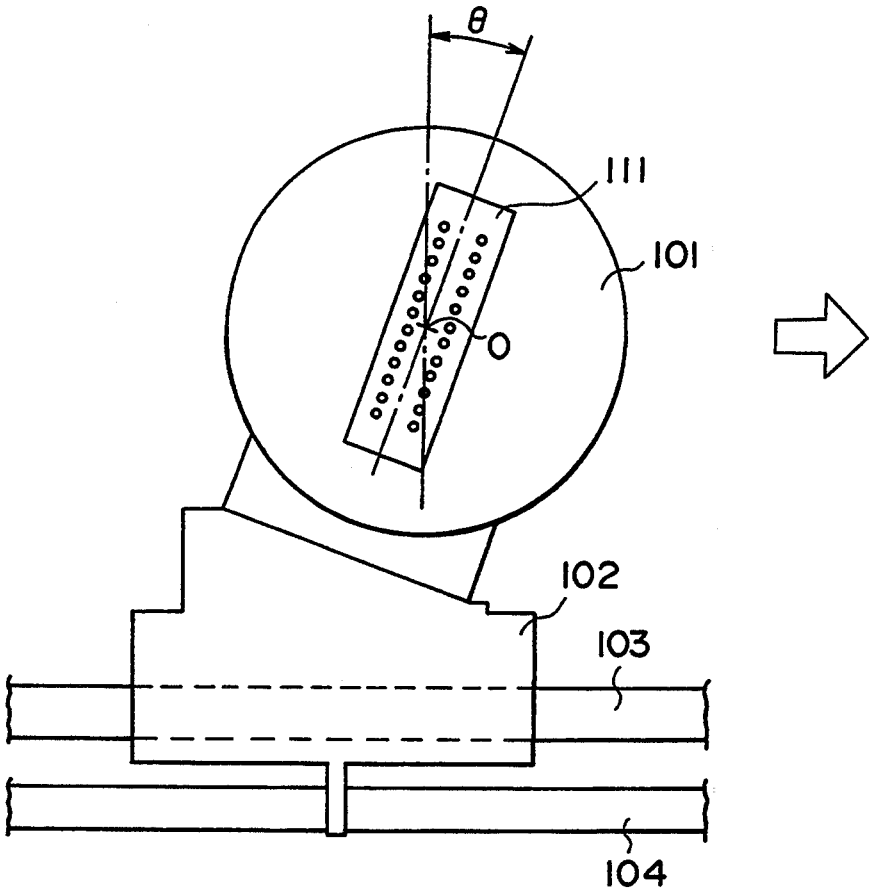
FIG. 9 is a front view showing the positional relationship between the carriage and the head of the second embodiment of the present invention.
Figure 10:
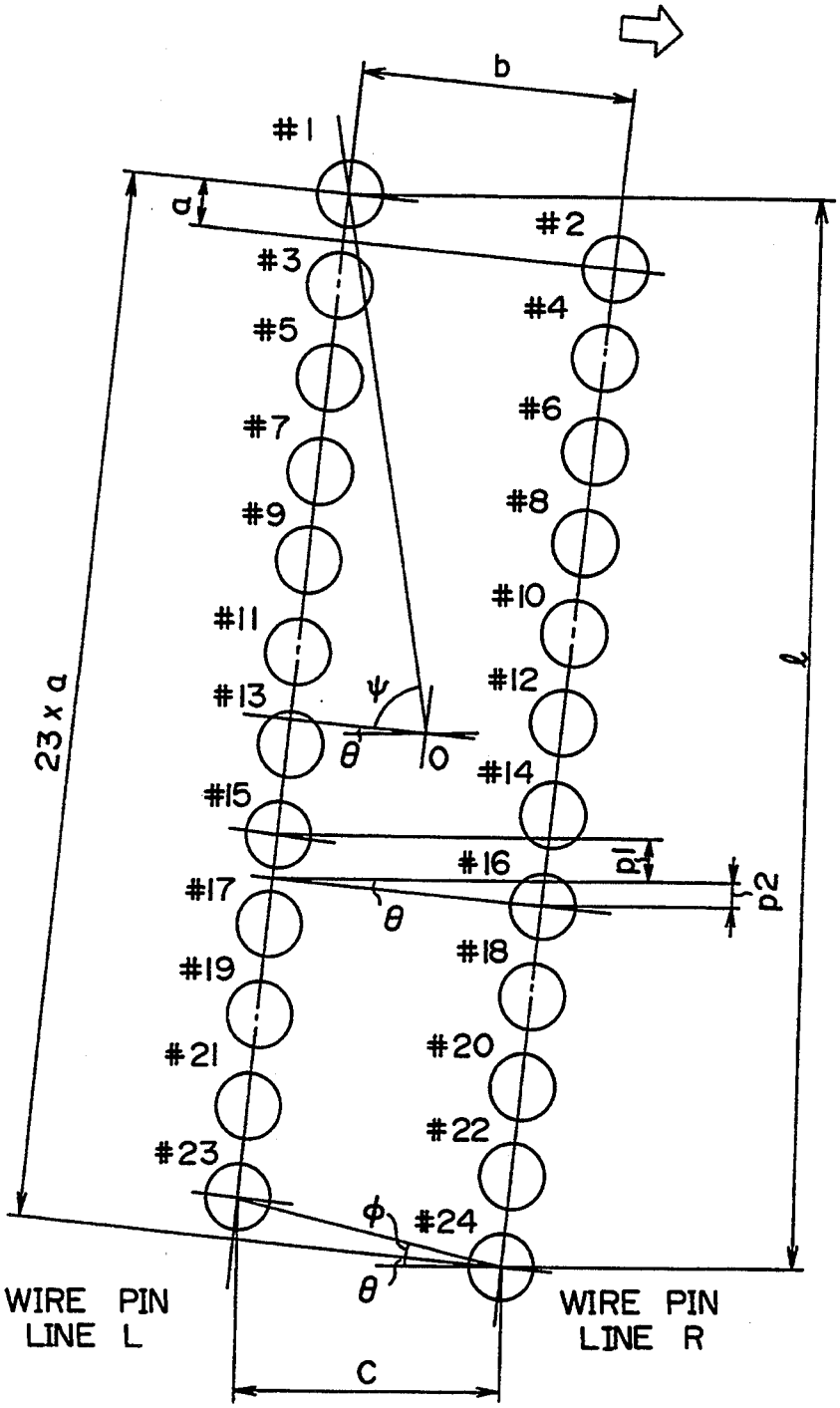
FIG. 10 is an illustration showing the arrangement of the wire pins of the printing head used for the second embodiment of the present invention.

FIG. 9 shows a front view showing the printing head 101 mounted on the carriage 102 when seen from the platen side. On the head portion 111 of the printing head 101, two arrangement lines of the wire pins set being inclined at a center O of the wire pin array by an angle $\theta$ (which satisfies the formula 1 below) with respect to the virtual vertical direction (the vertical direction to the axis of the platen 105).

$$\tan\theta \leqq a(2\times b) \quad (1)$$

where a and b denote distances as shown in FIG. 10.

FIG. 10 is an enlarged view showing the wire pin array arranged on the printing head 101, when seen from the side of the printing paper surface, in which the wire pins are arranged along the two arrangement lines. In FIG. 10, a left arrangement line L is composed of 12 wire pins of odd numbers from #1 to #23 and a right arrangement line R is composed of 12 wire pins of even numbers from #2 to #24. Further, the distance between two adjacent wire pins is 2.a, and the distance between the two arrangement lines is b. Further, the respective wire pins are arranged in zigzag fashion in such a way that the centers of the wire pins of one arrangement line are located at the middle points between the respective two wire pins of the other arrangement line. Here, the middle point of the oblique line connecting the first uppermost wire pin #1 of the left wire pin arrangement line and the last lowermost wire pin #24 of the right wire pin arrangement line is defined as a wire pin array center O. Further, Table 1 below lists exemplary values of a and b.

TABLE

| |
|---|
| a 1/180 (inch) |
| b 1/30 (inch) |

Here, originally, the printing head 101 is designed so that characters of a correct height can be printed under the conditions that the respective wire pin arrangement lines are set in the virtual vertical direction. Therefore, if the wire pin arrangement lines are inclined by an angle $\theta$ as shown in FIG. 10, the character height l changes as calculated by formula 2 below:

$$l=2((23\cdot a/2)^2+(b/2)^2)^{\frac{1}{2}}\sin(\psi+\theta) \quad (2)$$

where $\psi=\tan^{-1}(23\cdot a/b)$

Here, if $(\psi+\theta)$ exceeds 90 degrees, since the right and left positional relationship between the wire pins (e.g., #1 and #24) arranged at the ends of the wire pin arrangement lines R and L is reversed, so that the pin #1 is located on the right side of the pin #24. Accordingly, the value of $(\psi+\theta)$ is determined less than 90 degrees. In this range, the character height becomes larger than that obtained when the printing head is not inclined.

Therefore, the error $\epsilon 1$ can be expressed as a percentage ratio of the error value (the correct character height 23. a is subtracted from the character height l of when inclined by an angle $\theta$ with respect to the virtual vertical direction) to the correct character height 23·a as follows:

$$\epsilon 1=(l-23\cdot a)/(23\cdot a)\times 100 \quad (3)$$

Further, when the printing head 101 is inclined by an angle $\theta$ with respect to the virtual vertical direction, since the horizontal line passing through the middle point between the tow adjacent wire pins arranged in the wire pin arrangement line R is offset downward away by a distance p2, as shown in FIG. 10, from the horizontal line passing through the middle point between the tow adjacent wire pins arranged in the wire pin arrangement line L, this offset exerts an harmful influence upon the printing quality as dot non-uniformity. The above-mentioned offset value p2 can be expressed as follows:

$$p2=b\cdot\sin\theta \quad (4)$$

Here, the dot pitch error $\epsilon 2$ can be expressed as a percentage ratio of the offset value p2 to a pitch p1 (shown in FIG. 10) as follows:

$$\epsilon 2=p2/(a\cdot\cos\theta)\times 100=(b/a)\tan\theta\times 100 \quad (5)$$

Figure 11:
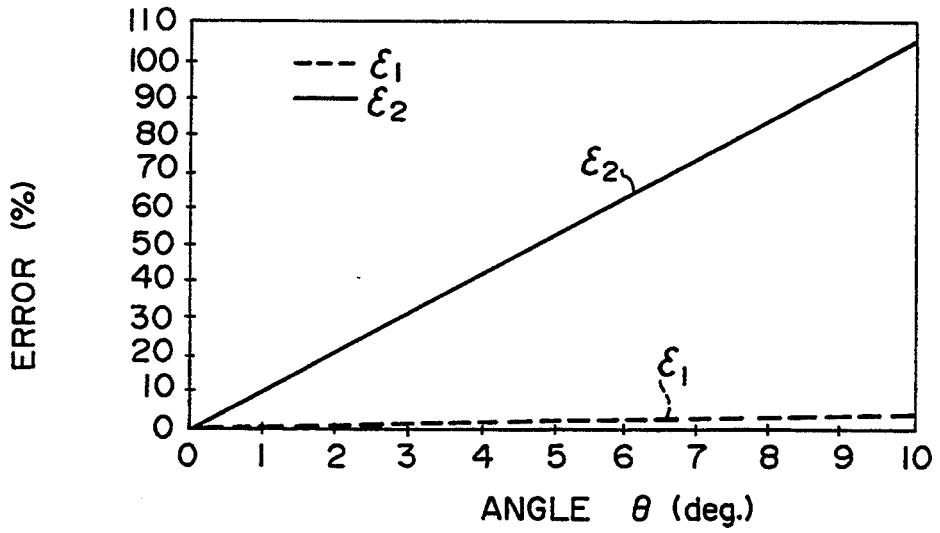
FIG. 11 is a graphical representation showing a deterioration of the printing quality of the second embodiment.

FIG. 11 is a graph showing the relationship between the character height error $\epsilon 1$, the dot pitch error and the inclined angle $\theta$, in which the values as listed in Table 1 are used as the values a and b of the actual printing head values. FIG. 11 indicates that the dot pitch error $\epsilon 2$ is a more serious factor to the printing quality, than the character height error $\epsilon 1$.

Figure 12:
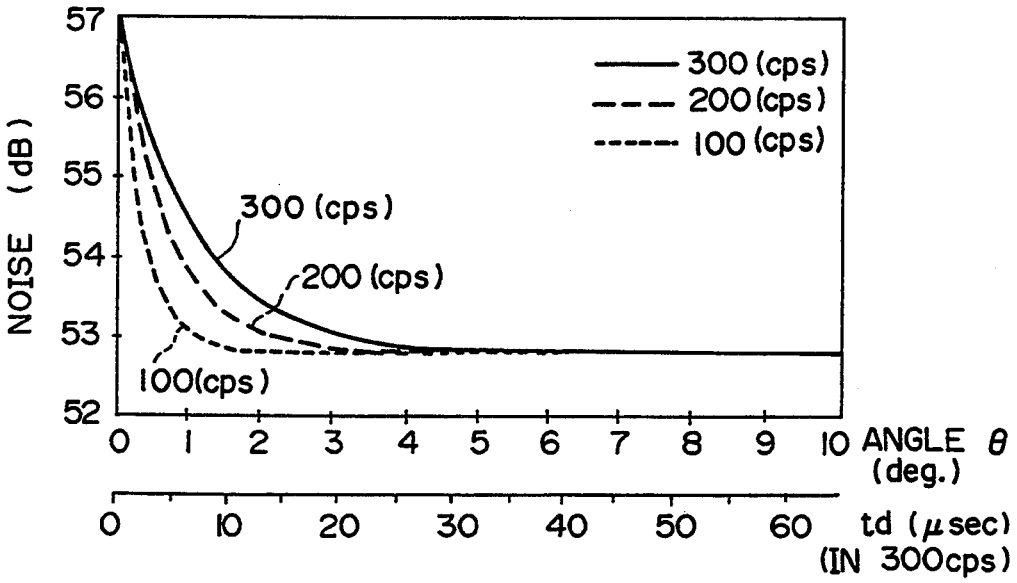
FIG. 12 is a graphical representation showing noise reduction effect of the second embodiment.

On the other hand, FIG. 12 is a graph showing the relationship between the printing noise (dB) and the inclined angle $\theta$ of the wire pin arrangement lines L and R with respect to the virtual vertical direction, the delay time td of the pin drive timing. Here, the delay times td taken along the abscissa are offset times of the impact timings among the adjacent wire pins arranged in the respective wire pin lines, which can be expressed by the following formula:

$$td=2\cdot a\cdot\sin\theta/Vcr \quad (6)$$

where Vcr denotes the carriage scanning speed.

The delay time td as shown in the abscissa in FIG. 12 corresponds to middle class printers such that 300 characters of a standard size (10 characters are arranged within an inch) are printed per sec (300 cps). Therefore, it should be noted that the delay time td corresponding other class printers of 100 or 200 cps are not shown. FIG. 12 indicates that the noise reduction effect converges roughly to a constant value when the angle $\theta$ reaches about 4.5 degrees, irrespective of the printing speed. This value corresponds to the delay time td=28 ($\mu$sec) where the printing speed is 300 cps.

In general, the limit of the allowable dot pitch error $\epsilon 2$ is about 50% from the standpoint of printing quality. The inclination angle $\theta$ of the printing head corresponding to this limit is about 4.5 degrees. The inclination angle of 4.5 degrees of when $\epsilon 2=50\%$ matches the angle $\theta$ at which the printing noise reduction effect roughly converges in FIG. 12. Therefore, it is understood that there exists an optimum angle value within the range where the $\epsilon 2$ is less than 50%, by which both the printing quality and the printing noise reduction can be both compatible with respect to each other. Therefore, the range of $\epsilon 2\leqq 50$ indicates the range as expressed by the formula (1) on the basis of the formula (5).

Further, in this embodiment, since the printing head 101 is inclined with the wire line center O as its center, the change in distance d between the end 111 of the printing head 101 and the platen 105 is symmetrical with respect to the horizontal line (i.e. upward and downward), so that it is possible to minimize the harmful influence of the change in distance d upon the printing quality.

Figure 13:
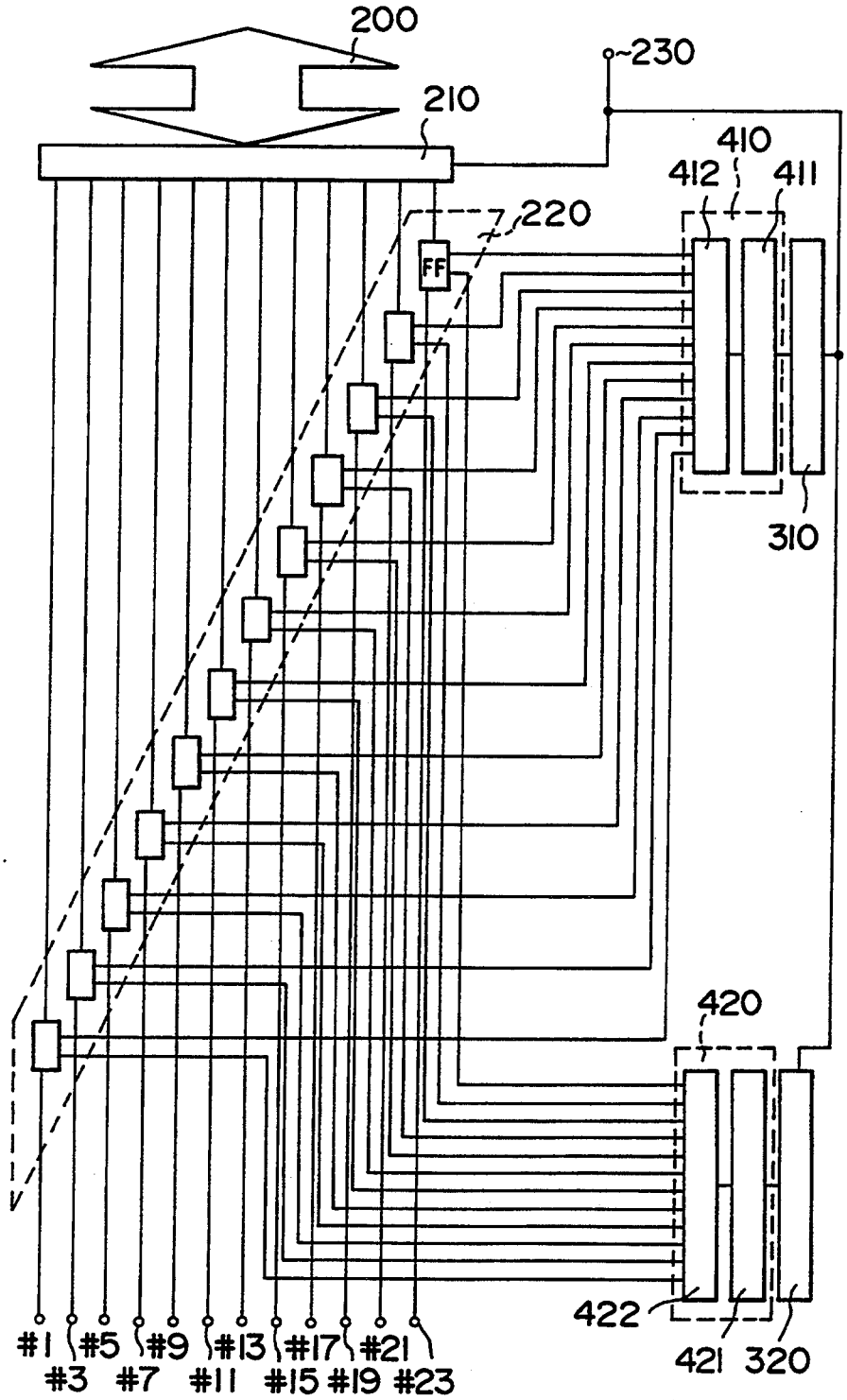
FIG. 13 is a block diagram showing a circuit for controlling the timing of driving the wire pins of the second embodiment.

FIG. 13 is a block diagram showing an embodiment of the control circuit for determining the timings for driving the respective wire pins of the printing head 101. In this control circuit, a printing data latch circuit 210 connected to a data bus 200, for latching printing data is connected to a printing data outputting circuit 220 for turning on or off the printing data for each wire pin. Further, a printing start timer 310 for generating a pulse with a period of the delay time td is connected to a printing start control circuit 410. The output of the printing start control circuit 410 is connected to the terminals of the printing data outputting circuit 220 corresponding to the respective wire pins. In the same way, a printing stop timer 320 for generating a pulse with a period of the delay time td is connected to a printing stop control circuit 420. The output of the printing stop control circuit 420 is connected to the terminals of the printing data outputting circuit 220 corresponding to the respective wire pins. Further, a printing control signal line 230 is connected to the printing data latch circuit 210, the printing start timer 310, and the printing stop timer 320. In FIG. 13, only the control circuit for the wire pin line L is shown, however, another similar control circuit is also provided for the wire pin line R.

In the control circuit as shown in FIG. 13, a buffer circuit can be used as the printing data latch circuit, and a flip-flop array can be used as the printing data outputting circuit 220. Further, as the printing start control circuit 410 and the printing stop control circuit 420, a combination of up-down counters 411 and 421 and decoders 412 and 422 can be used. In this case, the output of the buffer 210 is connected to the data terminal of the flip-flop array 220; the output of the decoder 412 is connected to the trigger terminal of the flip-flop array 220; and the output of the decoder 422 is connected to the clear terminal of the flip-flop array 220.

The operation of the control circuit as shown in FIG. 13 of when the carriage 102 moves in the arrow direction as shown in FIG. 9 will be described with reference to a timing chart shown in FIG. 14, in which the high level indicates turn-on status and the low level indicates turn-off status.

The counting direction of the up-down counters 411 and 421 is previously set to up-counting by a control unit (not shown). First, when the printing control signal for the wire pin arrangement line L is turned on, the printing data being outputted to the data bus 200 is latched by the printing data latch circuit 210, and at the same time the printing start timer 310 starts counting. The decoder 412 turns on the trigger terminal of the flip-flop corresponding to the wire pin #1 of the printing data output circuit 220 for initialization, so that upon the turning on of the printing control signal, the printing data bit corresponding to the wire pin #1 is outputted from the printing data outputting circuit 220. Thereafter, when the delay time td has elapsed, the printing start timer 310 generates a pulse. The generated pulse is inputted to the up-down counter 411, so that the output of the decoder 412 connected to the trigger terminal of the flip-flop corresponding to the wire pin #3 of the printing data output circuit 220 is tuned on. Therefore, the succeeding printing data bit is outputted from the printing data outputting circuit 220. In the same way as above, the continuous printing data bits for the wire pin line L are outputted from the printing data outputting circuit whenever the delay time td has elapsed. The outputted bits are inputted to a printing head driver (not shown) to drive the corresponding wire pins, respectively.

Figure 14:
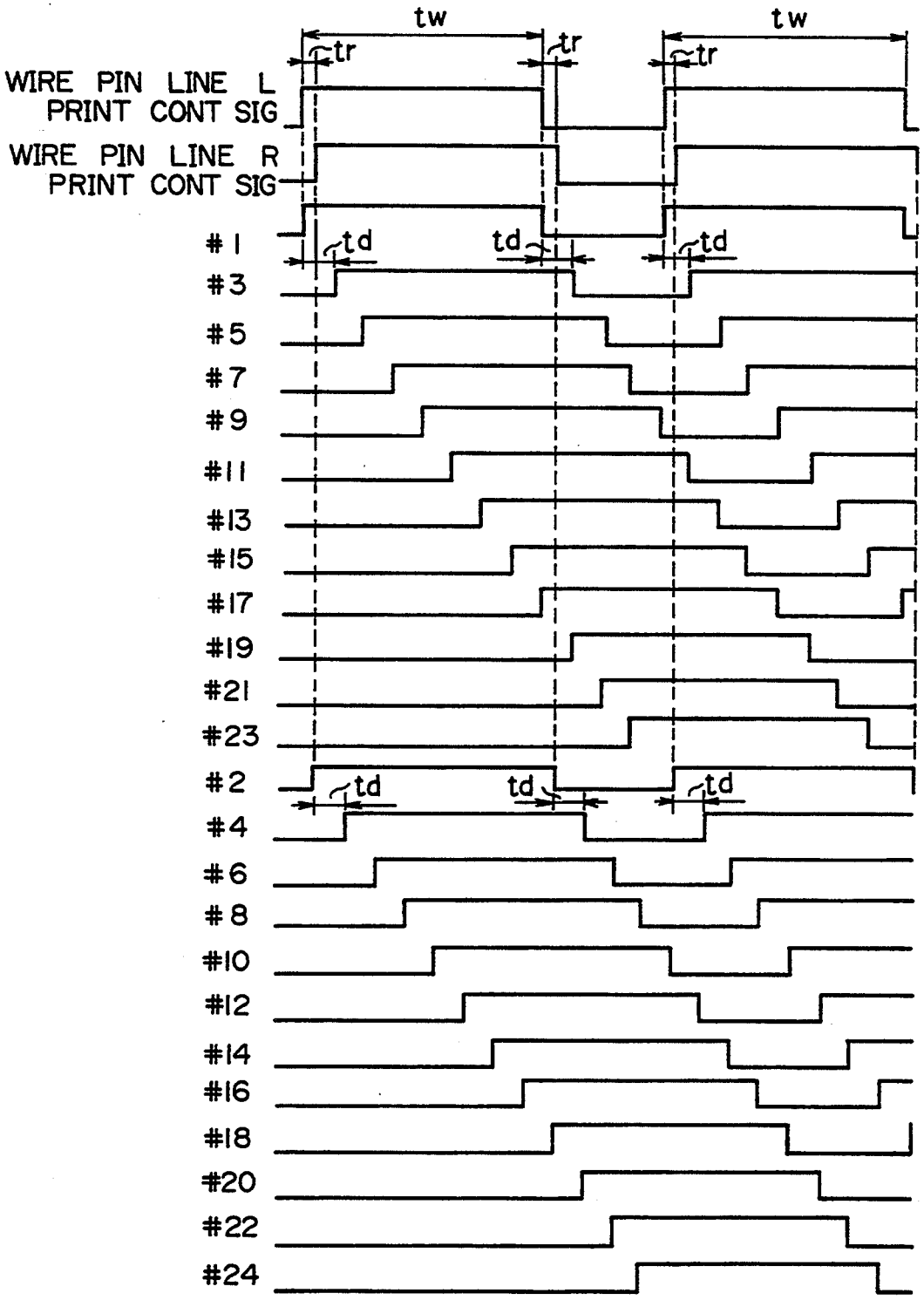
FIG. 14 is a timing chart for assistance in explaining the operation of the circuit shown in FIG. 13.

When the time width tw required to drive a single wire pin has elapsed as shown in FIG. 14, the printing control signal for the wire pin arrangement line L is turned off, and further the printing stop timer 320 starts counting. The decoder 422 turns on the clear terminal of the flip-flop corresponding to the wire pin #1 of the printing data output circuit 220 for initialization, so that upon the turning off of the printing control signal, the printing data bit corresponding to the wire pin #1 is not outputted from the printing data outputting circuit 220. Thereafter, when the delay time td has elapsed, the printing stop timer 320 generates a pulse. The generated pulse is inputted to the up-down counter 421, so that the output of the decoder 422 connected to the clear terminal of the flip-flop corresponding to the wire pin #3 of the printing data output circuit 220 is tuned on. Therefore, the succeeding printing data bit is stopped from being outputted from the printing data outputting circuit 220. In the same way as above, the continuous printing data bits for the wire pin line L are stopped from being outputted from the printing data outputting circuit whenever the delay time td has elapsed. Therefore, the printing head drivers (not shown) stop driving the corresponding wire pins.

In general, the interval b (in FIG. 10) between the two wire pin arrangement lines L and R along which the wire pins are arranged in zigzag fashion is so designed at to be an integer times of the dot pitch, and the wire pin arrangement lines L and R are driven at the same timing. In the case of the printing head having the values as listed in Table 1, the wire pin arrangement line interval b is 1/30 inch, which corresponds to the distance of 12 dots for high quality printing. In the case of the present invention, however, since the printing head 101 is mounted in the inclined state by an angle $\theta$ which satisfies the formula (1), the horizontal distance between the two wire pin arrangement lines L and R is c as shown in FIG. 10, which is shorter than the original distance. Therefore, when the carriage 102 is scanned in the arrow direction shown in FIG. 9, the printing control signal of the wire pin arrangement line L must be outputted from the control unit (not shown) a correction time tr earlier than the printing control signal for the wire pin line R, as shown by the printing timing chart for all the wires shown in FIG. 14. The correction time tr can be expressed as follows:

$$tr=(b-(a^2+b^2)^{\frac{1}{2}}\cdot\cos(\phi+\theta))/Vcr \quad (7)$$

where $\phi=\tan^{-1}(a/b)$

When the carriage 102 is scanned in the direction opposite to the arrow shown in FIG. 1, since the sequence of the driven wire pins must be reversed, the counting direction of the up-down counters 411 and 421 is set to the down counting direction by the control unit (not shown). Further, the printing control signal of the wire pin arrangement line R is so controlled by a control unit (not shown) as to be outputted earlier by a correction time tr determined by the formula (7).

Further, in the above-mentioned embodiment, the up-down counter and the decoder are combined as the printing start control circuit 410 or the printing stop control circuit 420. Without being limited thereto, however, it is possible to use other circuits such as shift registers, for instance.

In the above-mentioned embodiment, in order to offset the driving timing between the wire pin arrangement lines L and R by a correction time tr defined by the formula (7), it is necessary to provide both independent drive timing control circuits for each wire pin arrangement line L and R, so that there exists a problem in that the circuit configuration is rather complicated and therefore costly.

To solve this problem, another embodiment will be described hereinbelow. In this embodiment, a half of the delay time td is used instead of the correction time tr between the wire pin arrangement lines to use in common the timing control circuit for both the wire pin arrangement lines L and R. In other words, the driving timing control circuit is so configured that the wire pins are driven in sequence in the order of the pin numbers at time intervals of td/2 to control the two wire pin arrangement lines L and R by the single control circuit. In this case, however, since an error is produced between the accurate correction time tr between the two wire pin arrangement lines and the correction time td/2 used by the control circuit, a printing positional offset occurs inevitably, so the printing quality deteriorates. This error $\epsilon 3$ can be defined by subtracting a distance corrected by the correction time td/2 from a shortened distance (b−c) between the two wire pin arrangement lines given by the formula (7) and by expressing this distance in the ratio to the pitch e between the dots as follows:

$$\begin{aligned}\epsilon 3 &= [b\{1-\cos(\phi+\theta)/\cos\phi\} - Vcr\cdot td/2]/e\times 100 \\ &= [b\{1-\cos(\phi+\theta)/\cos\phi\} - a\cdot\sin\theta]/e\times 100 \\ &= b\cdot(1-\cos\theta)/e\times 100\end{aligned} \tag{8}$$

When the above formula is applied to the printer (360 dpi) which can print 360 dots per inch, the formula (8) can be expressed as follows:

$$\epsilon 3 = b(1-\cos\theta)\cdot 360/25.4\times 100 \tag{9}$$

where 1 inch is 25.4 mm and the distance b between the wire pin arrangement lines is also expressed in the unit of mm.

Figure 15:
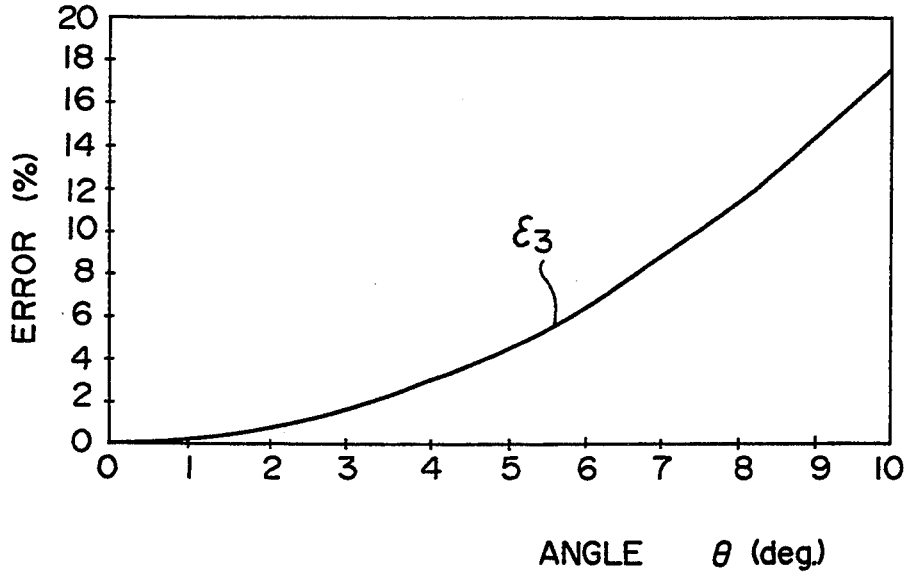
FIG. 15 is a graphical representation showing a deterioration of the printing quality of a third embodiment according to the present invention.

FIG. 15 is a graph showing the relationship between this error $\epsilon 3$ and the inclination angle $\theta$ of the printing head 101, in which the angle $\theta$ is taken on the abscissa and the error $\epsilon 3$ is taken on the ordinate. As already explained, since the dot pit error $\epsilon 2$ is more serious than the character height error $\epsilon 1$ for the printing quality, the dot pit error $\epsilon 2$ shown in FIG. 11 is compared here with the error $\epsilon 3$ shown in FIG. 15. The error $\epsilon 2$ is an error in the vertical direction, so that this error exerts an influence only upon the roughness and fineness of vertical ruled lines. On the other hand, the error $\epsilon 3$ is an error in the horizontal direction, so that this error exerts a serious influence upon the straightness of the vertical ruled lines. In other words, it is understood that the error $\epsilon 3$ is more serious than the error $\epsilon 2$ with respect to the printing quality. The allowable limit of the error $\epsilon 3$ is about 4%, and the angle $\theta$ corresponding to this value is about 4.5 degrees in FIG. 15. This angle $\theta$ is roughly a value to which the noise reduction effect converges as understood in FIG. 12. Therefore, if the inclination angle $\theta$ of the printing head is smaller than this value, it is possible to obtain the printing quality within an allowable range by controlling both the wire pin arrangement lines L and R with a single control circuit. The formula (1) expresses this inclination angle range as a general expression. In other words, it is understood that an optimum value compatible with both the printing quality and the printing noise reduction exists within the angle range expressed by the formula (1).

Figure 16:
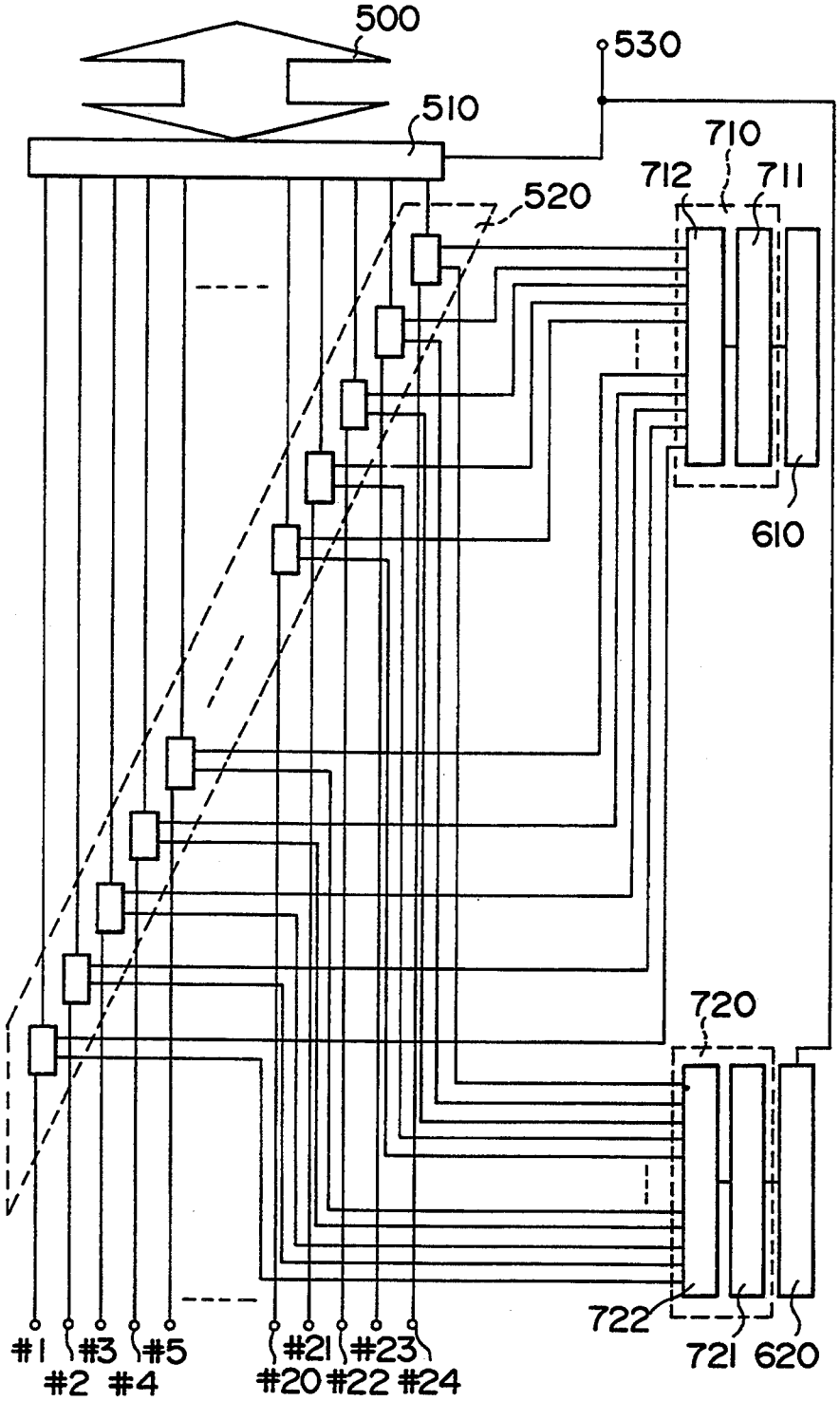
FIG. 16 is a block diagram showing a circuit for controlling the timing of driving-the wire pins of the third embodiment.

FIG. 16 is a block diagram showing a single control circuit for determining the timings for driving all the wire pins #1 to #24 arranged on the printing head 101. In this control circuit, a printing data latch circuit 510 connected to a data bus 500, for latching printing data is connected to a printing data outputting circuit 520 for turning on or off the printing data for each bit corresponding to each wire pin. Further, a printing start timer 610 for generating a pulse with a period of the delay time td is connected to a printing start control circuit 710. The output of the printing start control circuit 710 is connected to the terminals of the printing data outputting circuit 520 corresponding to the respective wire pins. In the same way, a printing stop timer 620 for generating a pulse with a period of the delay time td is connected to a printing stop control circuit 720. The output of the printing stop control circuit 720 is connected to the terminals of the printing data outputting circuit 520 corresponding to the respective wire pins. Further, a printing control signal line 530 is connected to the printing data latch circuit 510, the printing start timer 610, and the printing stop timer 620.

In the control circuit as shown in FIG. 16, a buffer circuit can be used as the printing data latch circuit 510, and a flip-flop array can be used as the printing data latch circuit 520. Further, as the printing start control circuit 710 and the printing stop control circuit 720, a combination of up-down counters 711 and 721 and decoders 712 and 722 can be used. In this case, the output of the buffer 510 is connected to the data terminal of the flip-flop array 520; the output of the decoder 712 is connected to the trigger terminal of the flip-flop array 520; and the output of the decoder 722 is connected to the clear terminal of the flip-flop array 520.

The operation of the control circuit as shown in FIG. 16 of when the carriage 102 moves in the arrow direction as shown in FIG. 9 will be described with reference to a timing chart shown in FIG. 17, in which the high level indicates turn-on status and the low level indicates turn-off status.

The counting direction of the up-down counters 711 and 721 is previously set to up-counting by a control unit (not shown). First, when the printing control signal for the wire pin arrangement line L is turned on, the printing data being outputted to the data bus 500 is latched by the printing data latch circuit 510, and at the same time the printing start timer 610 starts counting. The decoder 712 turns on the trigger terminal of the flip-flop corresponding to the wire pin #1 of the printing data output circuit 520 for initialization, so that upon the turning on of the printing control signal, the printing data bit corresponding to the wire pin #1 is outputted from the printing data outputting circuit 520. Thereafter, when the delay time td/2 has elapsed, the printing start timer 610 generates a pulse. The generated pulse is inputted to the up-down counter 711, so that the output of the decoder 712 connected to the trigger terminal of the flip-flop corresponding to the wire pin #2 of the printing data output circuit 520 is tuned on. Therefore, the succeeding printing data bit is outputted from the printing data outputting circuit 720. In the same way as above, the continuous printing data bits are outputted from the printing data outputting circuit 520 whenever the delay time td/2 has elapsed. The outputted bits are inputted to a printing head driver (not shown) to drive the corresponding wire pins, respectively.

Figure 17:
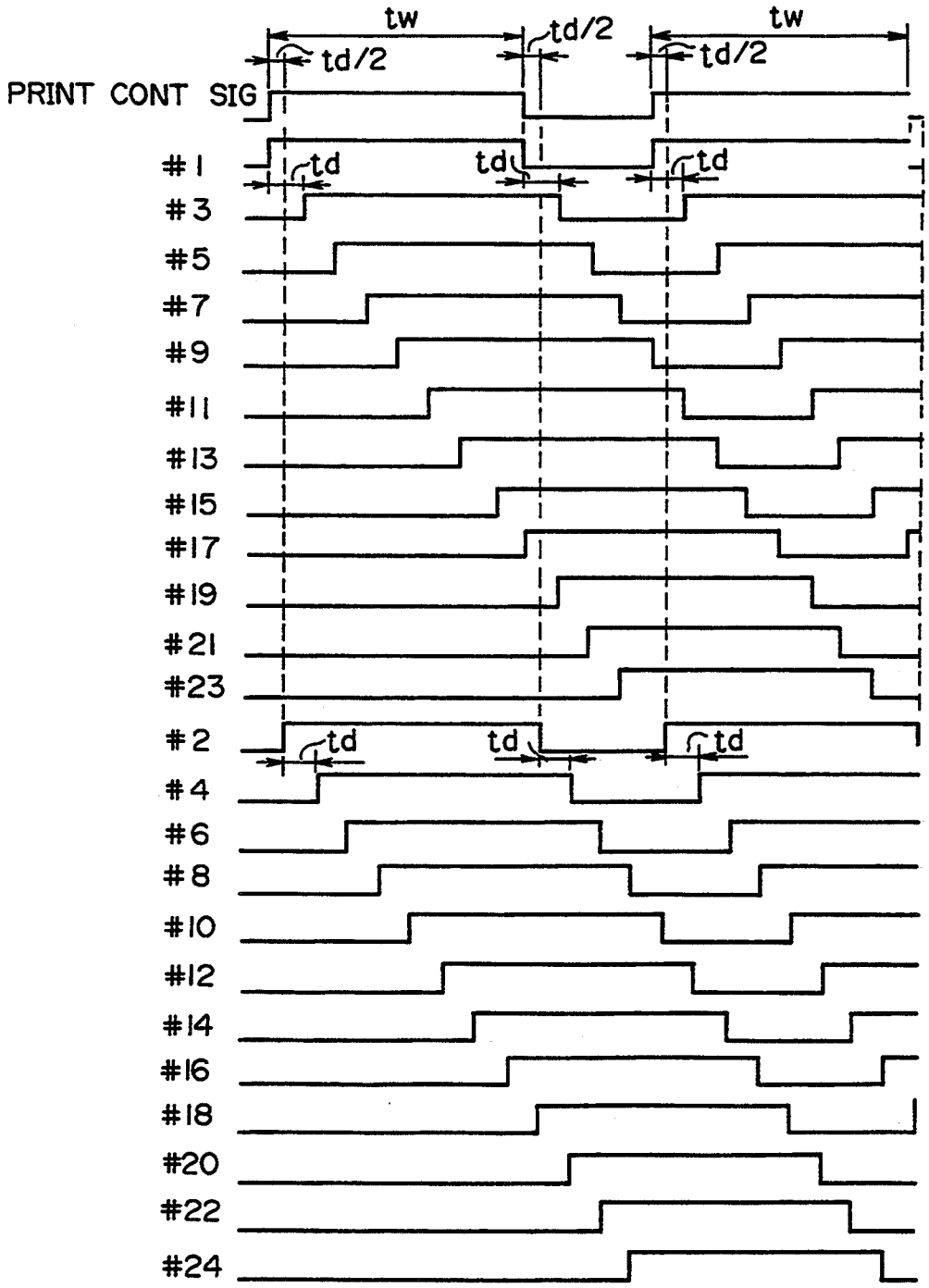
FIG. 17 is a timing chart for assistance in explaining the operation of the circuit shown in FIG. 16.

When the time width tw required to drive a single wire pin has elapsed as shown in FIG. 17, the printing control signal for the wire pin is turned off, and further the printing stop timer 620 starts counting. The decoder 722 turns on the clear terminal of the flip-flop corresponding to the wire pin #1 of the printing data output circuit 520 for initialization, so that upon the turning off of the printing control signal, the printing data bit corresponding to the wire pin #1 is not outputted from the printing data outputting circuit 520. Thereafter, when the delay time td/2 has elapsed, the printing stop timer 620 generates a pulse. The generated pulse is inputted to the up-down counter 721, so that the output of the decoder 722 connected to the clear terminal of the flip-flop corresponding to the wire pin #2 of the printing data output circuit 520 is tuned on. Therefore, the succeeding printing data bit is stopped from being outputted from the printing data outputting circuit 520. In the same way as above, the continuous printing data bits are stopped from being outputted from the printing data outputting circuit 520 whenever the delay time td/2 has elapsed. Therefore, the printing head drivers (not shown) stop driving the corresponding wire pins.

When the carriage 102 is scanned in the direction opposite to the arrow shown in FIG. 9, since the sequence of the driven wire pins must be reversed, the counting direction of the up-down counters 711 and 721 is set to the down counting direction by the control unit (not shown).

Further, in the above-mentioned embodiment, the up-down counter and the decoder are combined as the printing start control circuit 710 and the printing stop control circuit 720. Without being limited thereto, however, it is possible to use other circuits such as shift registers, for instance.

What is claimed is:

1. A circuit of an impact printer provided with a scanning printing head including an array of impact elements disposed along a line, said line being inclined at an angle with respect to a vertical line, the circuit controlling timing of driving each of the impact elements of the array so that the impact elements of the array are driven along the vertical line, the circuit comprising:

delay rate register means for storing a predetermined delay time according to the scanning speed of said printing head;

turn-on time generating means for generating a turn-on time signal having a predetermined time width in synchronism with a printing timing signal which is generated in response to the distance of movement of said printing head;

printing data register means for storing printing data;

latching means for separately latching the printing data bit by bit so as to output driving signals to drive said impact elements in said array;

start timing control means for generating a latch signal for latching the printing data bit by bit in time sequence in said latching means by firstly generating a counting signal by the interval based upon the delay time stored in said delay rate register means corresponding to the start of said turn-on time signal and secondly decoding the counted value of said counting signal; and stop timing control means for generating a reset signal for resetting the printing data bit by bit in time sequence by firstly generating a counting signal by the interval based upon the delay time stored in said delay rate register means corresponding to the end of said turn-on time signal and secondly decoding the counted value of said counting signal.

2. The circuit of claim 1, wherein said delay rate register means comprises:

basic delay rate register means for storing a predetermined basic delay time corresponding to a preset value of the inclination angle of the impact element array;

correction rate register means for storing a predetermined correction time corresponding to an error value of the inclination angle of the impact element array; and addition register means for storing an added value of the basic delay time and the correction time as the delay time.

* * * * *